United States Patent [19]

Fraige

[11] Patent Number: 4,479,275

[45] Date of Patent: Oct. 30, 1984

[54] WATERBED MATTRESS WITH FUNCTIONALLY NONREDUNDANT INNER BLADDER MEANS FOR WAVE ATTENUATION

[76] Inventor: Richard Fraige, P.O. Box 649, Carson City, Nev. 89701

[21] Appl. No.: 381,647

[22] Filed: May 24, 1982

Related U.S. Application Data

[63] Continuation of Ser. No. 96,427, Nov. 21, 1979, abandoned.

[51] Int. Cl.[3] ..... A47C 27/08

[52] U.S. Cl. ..... 5/450; 5/451; 5/455

[58] Field of Search ..... 5/451, 452, 450, 455, 5/449; 220/88 R

[56] References Cited

U.S. PATENT DOCUMENTS

| | | | |
|---|---|---|---|
| 3,017,642 | 1/1962 | Rosenberg et al. | 5/454 |
| 3,650,431 | 3/1972 | Stewart | 220/88 R |
| 3,864,768 | 2/1975 | Fraige et al. | 5/452 |
| 3,872,525 | 3/1975 | Lea et al. | 5/450 |
| 4,073,021 | 2/1978 | Carlisle | 5/451 |
| 4,079,473 | 3/1978 | Phillips | 5/452 |
| 4,168,555 | 9/1979 | Benjamin | 5/452 |
| 4,245,361 | 1/1981 | Evanson | 5/450 |

FOREIGN PATENT DOCUMENTS

| | | | |
|---|---|---|---|
| 608951 | 2/1979 | Switzerland | 5/455 |

*Primary Examiner*—Alexander Grosz

[57] ABSTRACT

An improved waterbed mattress with adjustable hydrostatic wave absorption comprising an outer water-inflatable bag-like enclosure provided with an inner wave-absorbing water bladder. When a user sits or lies on a conventional waterbed an undesirable wave front is created in the water contained in the waterbed mattress. The inner wave-absorbing water bladder of the present invention absorbs and diminishes this wave front and shifts its phase. The water bladder also changes its shape vertically and horizontally to block off the wave front and substantially seals off the balance of the enclosure from wave movement.

19 Claims, 25 Drawing Figures

WATERBED MATTRESS WITH FUNCTIONALLY NONREDUNDANT INNER BLADDER MEANS FOR WAVE ATTENUATION

This is a continuation of application Ser. No. 096,427, filed Nov. 21, 1979 now abandoned.

BACKGROUND OF THE INVENTION

This invention relates to waterbeds and, more specifically, to an improved motion control waterbed mattress. Waterbeds are ordinarily comprised of a rigid frame constructed of suitable plastic or wood supporting a bag-like enclosure which is filled with water. The frame serves to confine the water-inflatable bag-like enclosure which is ordinarily constructed of vinyl or other suitable watertight flexible sheets.

The waves created by the user's sitting, lying or moving on the waterbed mattress creates a major problem in the use of such waterbeds in that they cause discomfort for the user thereby discouraging waterbed use. In the past, attempts have been made to suppress this undesirable wave motion with varying degrees of success. Such prior motion suppression means include baffles, tie-downs, and floats with tie-downs and/or baffles tied to the underside of the top and/or upper side of the bottom of the bag-like enclosure of the waterbed mattress. However, these conventional motion suppression means require additional watertight seams at high stress points which eventually fail ultimately resulting in water leakage.

SUMMARY OF THE INVENTION

It is a major object of the present invention to inhibit and control undesirable wave movement in waterbed mattresses. As hereinafter explained, this object is attained by adjustably redirecting the energy of the wave front and sealing off most or an adjusted portion of the wave front thereby absorbing and dissipating the desired amount of its energy. It is also an object of the present invention to minimize the stress on a waterbed's outer watertight surface. This object is achieved by means hereinafter described including the reduction of the water volume in waterbed mattresses characterized by high stress seams and the containment of a like amount of such water in low stress water bladders disposed within the waterbed mattress.

Another important object of the present invention is to provide a system of wave control in waterbed mattresses through an uncomplicated structure, particularly without leakage-prone attachment of the inner bladder to the upper or lower sheets of the outer water-inflatable bag-like enclosure.

The safety benefits and advantages of the present invention are particularly important. Conventional waterbeds intended to inhibit undesirable wave movement are typically provided with baffles, coil tie-downs or the like to inhibit wave movement. These structures are butt seamed to the upper and/or lower surfaces of the outer bag-like enclosure. As the force of the wave strikes these baffles or tie-downs they resist the wave front and tug against the upper and/or lower surfaces to which they are attached by butt seams thereby causing leaks at these seams. A baffle system must typically inhibit in excess of 1,000 pounds of water from shifting sideways. The resulting stress commonly causes butt seam tear-outs which cannot be patched. The same problem exists in coil tie-down systems where the strain to stop wave movement causes unpatchable butt seam tear-outs in top and bottom sheets of the bag-like enclosure. These leakage and tear-out problems are eliminated in the present invention wherein the wave-inhibiting bladder is unattached to the upper or lower sheets of the outer bag-like enclosure except by the water filling means. Instead of the unyielding resistence to the wave front which characterizes baffles and tie-downs, the inner bladder reacts by moving and changing shape to intercept the wave front without undesirable tension. There is not even a leakage problem due to tension at the water filling means. The water-filled inner bladder is listless in movement. Thus, if the inner bladder is tugged or otherwise manipulated because of the impact of the wave front on the inner bladder the listless water-filled inner bladder will tend to adjust its position and dissipate substantially all of the wave's energy thereby eliminating stress on the water filling means. The unyielding tension which typically causes leaks at the butt seams in waterbed mattresses provided with butts or tie-downs is thereby avoided.

If a leak occurs in the out-side of the outer bag-like enclosure, approximately 50 percent of the total water volume is held intact in the non-leaking inner bladder. Moreover, another safety feature of the present invention is also significant. The inner water bladder contains an appreciable volume of the total volume contained by the waterbed mattress. If a leak occurs in the inner bladder no water drainage to the outside is possible because the leaking water is contained by the outer bag-like enclosure and the unit remains functioning as a waterbed mattress. These safety features make the present invention superior to prior wave-inhibiting waterbed structures which are characterized by numerous stressed leakage-prone seams attached to the inside of the outside sheets.

Another advantage of the present invention is that it permits adjustment of the wave movement without change in the total water volume and depth of the mattress. The waterbed of the present invention permits the user to select a desired amount of wave motion without sacrificing the waterbed's depth or its flotation. This is done by adjusting the relationship of water volume between the outer bag-like enclosure and the inner bladder. In prior waterbeds provided with means for inhibiting wave movement, adjustment of the wave movement requires adjustment of total water volume which changes the depth and flotation of the waterbed mattress simultaneously but not selectively.

Broadly considered, the improved waterbed mattress of the present invention is disposed in and supported by a rigid frame and is comprised of an outer water-inflatable bag-like enclosure and an inner hydrostatic wave absorber comprising at least one water bladder. Typically the outer water-inflatable bag-like enclosure is constructed of suitable watertight panels. In ordinary construction this bag-like enclosure is provided with a top panel, a spaced-apart bottom panel and one or more edge panels interconnecting the top and bottom panels. However, the invention also encompasses a bag-like enclosure which is constructed with or without separate top, bottom and side panels or constructed with any combination of said panels. The enclosure is also provided with a water filling and valve means.

The hydrostatic wave absorber is comprised of at least one water bladder disposed within the larger outer water-inflatable bag. Each water bladder may be unmodified but preferably is multi-tufted, or provided with baffles or tie-downs to enhance wave inhibition. The number, shape and size of these inner water bladders can vary considerably. Broadly considered, the volume of a modified inner bladder can be greater than the volume of an unmodified inner bladder without eliminating significant wave inhibition. The hydrostatic wave absorber is provided with an integral water spout or a water tube means to fill the wave absorber with water and bleed air away.

In operation the outer bag-like enclosure and the smaller inner wave-absorbing water bladder are filled with water. The relationship of water volume in the outer enclosure and inner bladder are adjusted to satisfy the user's preference. Because the inner water-filled bladder is surrounded by water it is devoid of significant stress due to differences in pressure. Rather, when both the smaller inner bladder and the larger outer bag-like enclosure are filled with water, the inner bladder is slack, substantially tensionless and readily distorted or moved within the water-filled outer bag-like enclosure.

When the user sits, lies or moves on the waterbed mattress the inner water bladder tends to distort horizontally and, most importantly, vertically in reaction to the wave front created in the water in the outer bag-like enclosure. More particularly, the bladder seals off, obstructs and intercepts the channels of wave movement at the wave front. The inner bladder also brings about a phase shift in the wave front thereby dissipating the undesirable effects of the waves.

In the foregoing description reference has been made to an inner wave-absorbing bladder filled with water. If desired, a jelling agent may be used to supplement the wave-absorbing feature of this inner water bladder provided that the hydrostatic wave-absorbing function of the inner bladder as hereinafter described in detail remains unchanged. More specificially, it is essential that each inner bladder of the present invention, with or without a jelling agent, is employed in the manner herein described so that the bladder changes its shape both vertically and horizontally to effectively block off the wave front and substantially seal off the balance of the enclosure from wave movement in the outer water-inflatable bag-like enclosure. Thus bladder configurations which do not function in the manner set forth in this specification are not within the scope of the present invention even if a jelling agent is used.

Other objects, advantages, benefits and features of the subject improved waterbed mattress with hydrostatic wave absorption not heretofore set forth will be more fully understood from the following description read in conjunction with the drawings in which:

DRAWING DESCRIPTION

DETAILED DESCRIPTION

Figure 1:
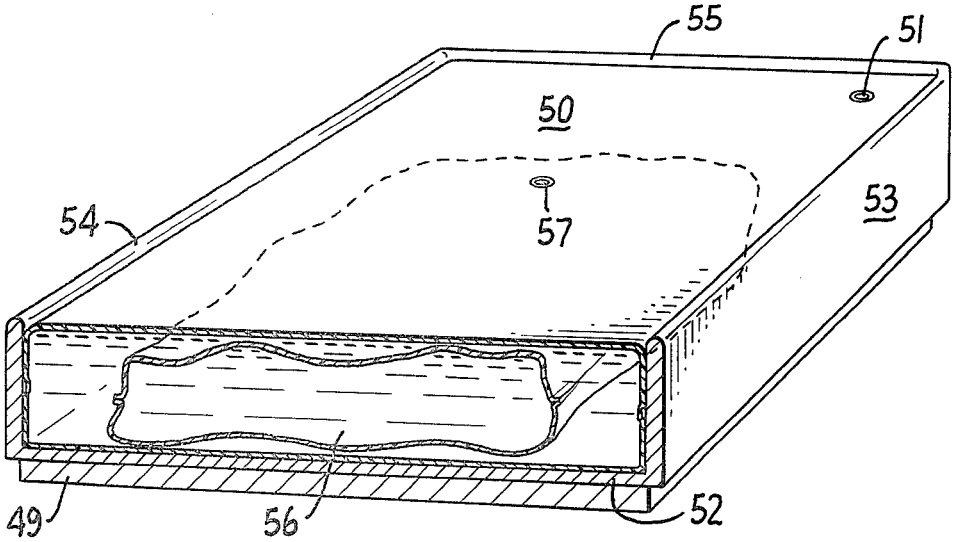
FIG. 1 is a perspective view of a waterbed within a rigid frame provided with an inner, adjustable wave-absorbing water bladder.

Referring to FIG. 1, which is a perspective view of the improved waterbed mattress in a rigid frame, the water-inflated mattress is seen to comprise an outer water-inflatable bag-like enclosure 50 provided with a plug 51 which serves as a water filling and valve means. The plug 51 for the outer water-inflatable bag-like enclosure 50 is used both to fill the enclosure 50 with water and to bleed air therefrom. Enclosure 50 is rectangular in shape, it being understood that other shapes are also encompassed by the present invention. The bag-like enclosure 50 rests in a rigid frame having a platform 52, side members 53 and 54, and end members including 55 resting on a base 49. The hydrostatic wave absorber 56 is provided with integral water spout 57 which serves as the water filling means for the wave absorber 56. It will be appreciated that the water filling means such as water spout 57 as used in all embodiments of the present invention have multiple uses. For example, they are used to center the water-filled bladder. They also serve to bleed air from the inner bladder as well as to fill and adjust the bladder with water. In FIG. 1, the adjustable hydrostatic wave absorber 56 is a single unmodified water bladder, it being understood that one or more unmodified or modified bladders are hereinafter described in more detail are also utilized and contemplated by the present invention.

Figure 2:
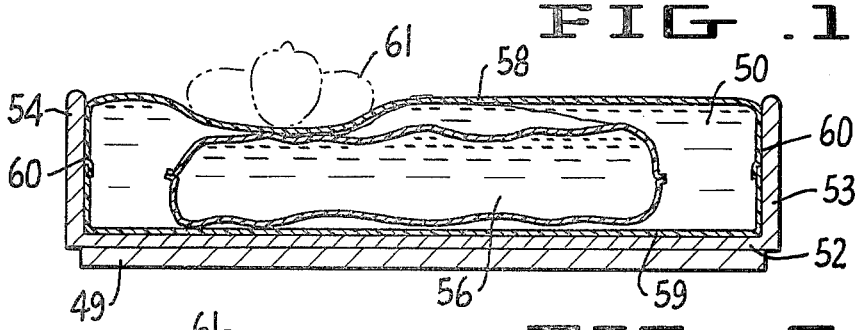
FIG. 2 is a cross-sectional view showing a supine figure lying on a water-inflated mattress provided with an inner, adjustable hydrostatic wave absorber.
Figure 3:
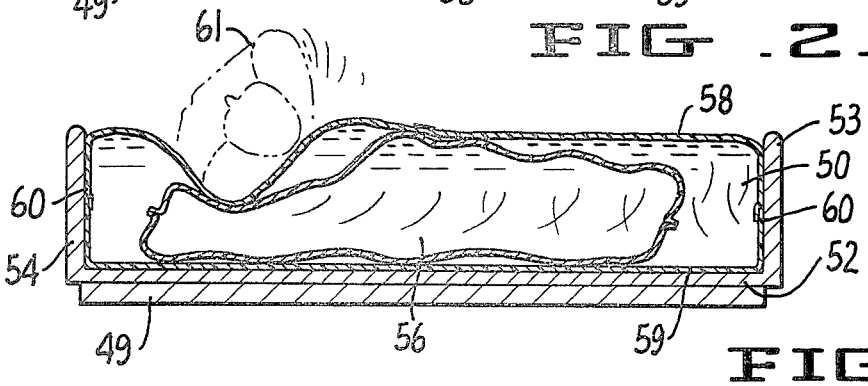
FIG. 3 is a cross-sectional view of the improved waterbed mattress shown in FIG. 2 illustrating the movement of an adjustable wave-absorbing water bladder when the figure lying on the water-inflated mattress moves.
Figure 4:
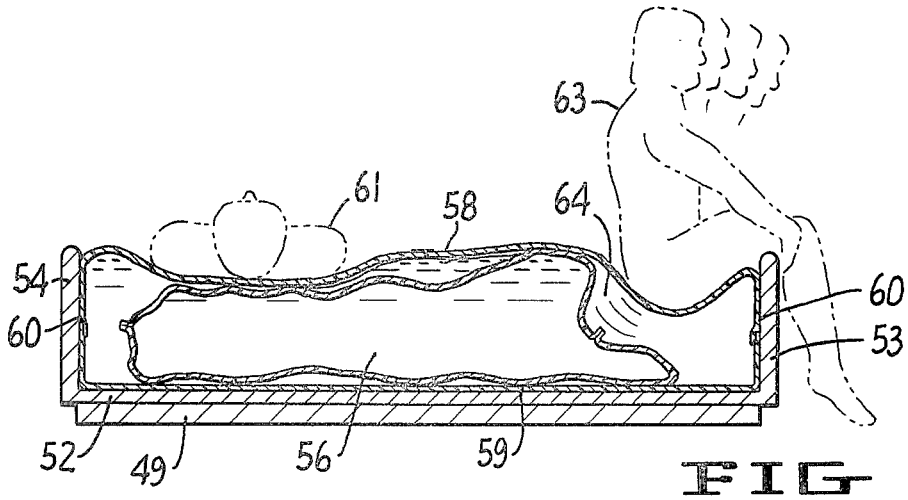
FIG. 4 is a cross-sectional view of an improved waterbed mattress provided with an adjustable wave-absorbing water bladder illustrating the typical movement of the bladder in sealing off waves when one figure rests and a second figure agitates the outer water-inflatable bag-like enclosure by sitting thereon.

Referring to FIGS. 2 through 4, the method by which the hydrostatic wave absorber inhibits waves in the water in the bag-like enclosure 50, while still insuring flotation for the user, is illustrated. In these figures, 58 denotes the top panel of the bag-like enclosure, 59 depicts the bottom panel of enclosure 50, and 60 refers to the edge panels interconnecting the top panel 58 with the spaced-apart bottom panel 59 of bag-like enclosure 50. It is to be understood that the outer bag-like enclosure need not be made in this manner. For example, enclosure 50 can be constructed of a single sheet of flexible watertight material.

FIGS. 1 through 4 show one or more supine figures resting on the improved waterbed mattress. As can be seen in these figures, the hydrostatic wave absorber 56 is only partially filled with water and is, accordingly, limp and highly deformable. The amount of resiliency of the sealed absorber 56 can be controlled by varying the volume of water contained therein by way of spout 57. For satisfactory operation, the absorber should provide no significant support to the user, but rather, should be easily displaced as can be seen in the drawings.

In FIG. 3, when the supine figure 61 moves, the water-filled hydrostatic wave absorber 56 distorts and tends to interrupt the wave front of the water in bag-like enclosure 50. The hydrostatic wave absorber 56 moves both vertically and horizontally in interrupting and absorbing the wave front and in so reacting to the wave front inhibits further movement of the wave front. The waves are also dissipated by the change of phase caused by movement of the hydrostatic wave absorber 56. The effectiveness of the adjustable hydrostatic wave absorber 56 is particularly illustrated in FIG. 4, wherein a sitting figure 63 creates a wave front 64 which is so effectively blocked by the change in shape of hydrostatic wave absorber 56 that the supine figure 61 remains substantially undisturbed by the wave front 64.

It should be recognized that the inner bladder has a distinct purpose from that of the same structure when used as a conventional waterbed. The water-filled inner bladder 56 interacts with the waer-filled outer water-inflatable bag-like enclosure 50 in a manner distinct from its operation when used as an unenclosed waterbed mattress. When used as an inner bladder the structue is virtually tensionless, whereas the same structure is subject to tension at all welds when not immersed in the water contained by the outer water-inflatable bag-like enclosure. Moreover, the inner bladder is not intended to be slept on directly. Rather it is used as a wave absorber. Thus, inner bladders may be used which are completely inappropriate in structure for use as a conventional waterbed mattress. Some examples of inner bladders which would not be used as an unenclosed waterbed mattress are shown in FIGS. 5 through 9. These modified bladders effectively control wave action but are unusable for use as a waterbed mattress when not disposed within an outer water-inflatable bag-like enclosure.

Figure 5:
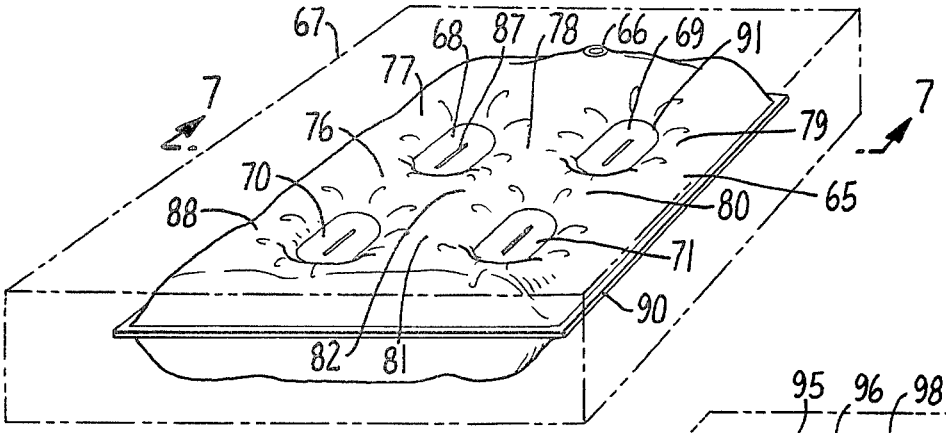
FIG. 5 is a perspective view of an improved waterbed mattress provided with an adjustable wave-absorbing water bladder which has been modified by the inclusion of four tufts.
Figure 6:
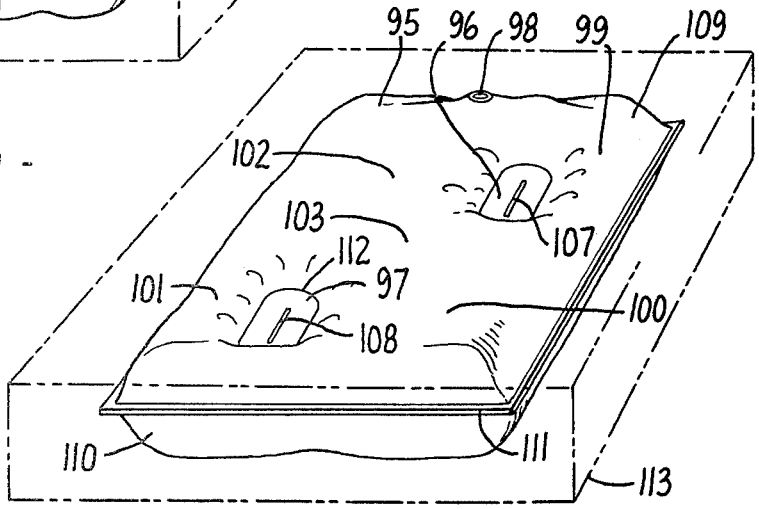
FIG. 6 is a perspective view of an improved waterbed mattress provided with an adjustable wave-absorbing bladder which has been modified by the inclusion of two tufts.
Figure 7:
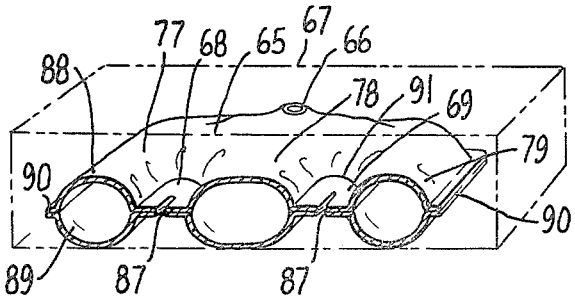
FIG. 7 is a cross-sectional view taken along the lines 7—7 of FIG. 5.

Referring to FIGS. 5 and 7, which constitute the preferred embodiment in further detail, a hydrostatic wave absorber in the form of a single modified inner bladder 65 is shown provided with an integral water spout 66 within the outer bag-like enclosure 67. Instead of an integral water spout, any other suitable water filling means, such as a water tube means, may be used for the purposes of this invention. It will be readily apparent that the inner bladders shown in FIGS. 5–9 are not attached to either the top or bottom of the inner wave-absorbing water bladder. Because of this lack of attachment the danger of leakage is mitigated while at the same time wave inhibition is effected. The bladder 65 is provided with four tufted welds 68, 69, 70 and 71. When water filled, the surface surrounding the tufts and between the tufts, such as 76, 77, 78, 79, 80, 81 and 82 of bladder 65, inflate outwardly or dome. Each tufted weld in the inner wave-absorbing bladder 65 is approximately six inches wide by one foot long. However, the size, shape and number of tufts may vary considerably without departing from the scope of the invention. Thus, one or more tufts may be used. By providing one or more tufts, doming is controlled and a larger wave-absorbing inner bladder may be employed than is possible with an umodified bladder. Moreover, the wave-inhibiting effect and edge support of the inner bladder is far superior to that provided by an unmodified bladder. By tufting, as shown in FIGS. 5 through 9, it is possible to employ a wider wave-absorbing inner bladder than is possible with an unmodified bladder thereby providing increased edge support.

Each tufted weld is provided with an escape means for air entrapped beneath the bladder. One embodiment of a suitable air escape means is shown at 87 in FIGS. 5 and 7. Slits 87 are provided to permit air beneath the water bladder 65 to move to the upper surface of the outer water-inflatable bag-like enclosure 67 where this entrapped air may be bled from the structure through the water filling means for the enclosure 67. It will be recognized that air escape means, other than slits 87, may be employed without departing from the scope of the invention. In this embodiment, if entrapped air escape means are not provided, entrapped air beneath the inner bladder may undesirably cause the water-filled inner bladder to float toward the top of the outer water-inflatable bag-like enclosure.

The inner bladder 65 depicted in FIGS. 5 and 7 is comprised of an upper sheet 88 and lower sheet 89 welded along their borders at 90. It will be recognized, however, that the present invention is not limited to this embodiment. Thus the inner bladder may be constructed of one or more sheets of suitable plastic or vinyl and welded or otherwise water sealed in accordance with methods known in the art. The welds which define the oval-shaped tufted welds are shown generally at 91. The size, number and shape of these tufted welds may vary considerably without departing from the scope of this invention. One or more tufted welds may be employed and the invention is not restricted to oval shapes or the size shown by way of illustration, nor is the invention restricted to welding. Other watertight sealing means may be employed throughout the invention as described.

FIG. 6 illustrates an alternate wave-absorbing inner bladder provided with two tufted welds or seals. More particularly, the bladder 95 is provided with two tufted welds 96 and 97 and an integral water spout 98. The tufted welds are offset from each other so that wave front in the inner bladder is broken up. When water filled, the surface surrounding the tufts and between the tufts, such as shown generally at 99, 100, 101, 102 and 103, inflate outwardly or dome. Slits in the oval-shaped tufted welds are shown at 107 and 108. Like the bladder shown in FIGS. 5 and 7, the bladder 95 shown in FIG. 6 is comprised of an upper sheet 109 and lower sheet 110 welded or otherwise sealed along their borders at 111. The seals which define the oval-shaped tufts are shown generally at 112 and the bladder 95 is disposed within an outer bag-like enclosure 113.

Figure 9:
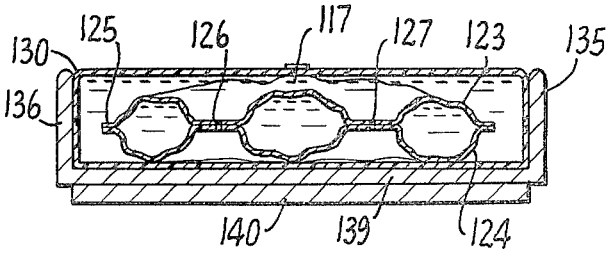
FIG. 9 is a cross-sectional view taken along the lines 9—9 of FIG. 8.
Figure 8:
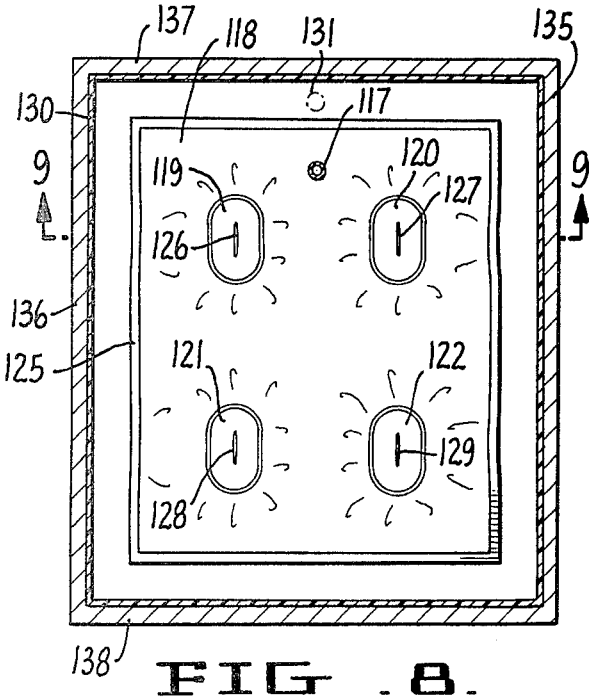
FIG. 8 is a top view of an improved waterbed mattress provided with an adjustable wave-absorbing bladder which has been modified by the inclusion of four tufts as shown in perspective in FIG. 5.

FIGS. 8 and 9 illustrate how the air escape means operate. The bladder 118 is provided with four tufts 119, 120, 121 and 122, is comprised of an upper sheet 123 and lower sheet 124 sealed at 125, and is provided with an integral water spout 117. Each tuft, 119 through 122, is provided with an air escape means. In the embodiment shown, the air escape means are slits 126, 127, 128 and 129. The modified bladder 118 is disposed within bag-like enclosure 130 which is contained within a rigid frame. The frame is comprised of side members 135 and 136, end members 137 and 138, and platform 139 which rests on base 140. When modified bladder 118 is water filled, air can be entrapped beneath its surface. This entrapped air can escape to the water surface through the air escape means 126 through 129. The water filling means 131 in bag-like enclosure 130 can then be used to bleed the air from the system.

FIGS. 10 through 13 also show modified adjustable hydrostatic wave absorbers as distinguished from the unmodified water bladder shown in FIGS. 1 through 4. Experimentation has shown that when an unmodified inner bladder, such as is shown in FIG. 1, is filled with water an undesirable doming effect is brought about which inhibits the wave control intended by the present invention. This doming, wherein the top of the inner water bladder bulges outward toward and touches the underside of the upper surface 58 of the outer water-inflatable bag-like enclosure 50 occurs when the bladder 56 in FIG. 1 is filled with water and can be avoided by modifying the inner water bladder 56. Thus, though an unmodified inner water-absorbing water bladder is contemplated by the present invention, it is not the preferred embodiment. Multi-tufted inner bladders, such as shown in FIGS. 5 through 9, which control the doming effect as shown in FIG. 9, are significantly better in operation offering improved wave control and edge support. Other forms of modification of the bladder 56, such as baffles and tie-downs, may also be used, as shown in FIGS. 10 through 13. However, these modifications are more costly, complex and trouble prone because of numerous additional welds.

If the inner bladder is provided with baffles or tie-downs, or is otherwise modified as described herein, it can be considerably larger than an unmodified inner bladder. A single unmodified inner bladder having approximately 45 percent or more of the volume of the outer bag-like enclosure will work relatively poorly and a single unmodified inner bladder which is 85 percent of the volume of the bag-like enclosure 50 will not provide the appreciable wave inhibition which is the goal of the present invention. On the other hand, if multiple unmodified bladders are used, their internal volume may total substantially in excess of 45 percent of the outer bag-like enclosure and work satisfactorily in inhibiting the wave front. When the outer bag-like enclosure 50 fits about the inner bladder 56 in glove-like fashion, the object of wave inhitibion cannot be attained. Thus, it will be recognized that the closer a single unmodified inner water bladder, such as 56 in FIG. 1, approaches the volume and configuration of the outer water-inflatable bag-like enclosure 50 in FIG. 1, the less effective the unmodified inner wave-absorbing water bladder will be. As the inner and outer bladders approach the same configuration in size and configuration, the bladders become redundant in function and the hydrostatic wave-absorber feature is eventually eliminated. A water-inflatable bag-like enclosure having a glove-like liner disposed about it will not bring about the effects sought by the present invention. The configuration contemplated by the present invention is not a glove or waterproof liner. Such glove and liners are neither intended nor constructed to function as part of a wave-inhibiting system for waterbeds. More specifically, liners are not constructed to permit water between the waterbed mattress and the liner and are not constructed ordinarily to permit filling of the waterbed mattress by a valve penetrating the liner.

When the hydrostatic wave-absorber is comprised of one or more modified inner bladders, as shown, for example, in FIGS. 5 through 9, it may be adjusted up to 85 percent of the volume of the outer water-inflatable bag-like enclosure. Ideally, the modified hydrostatic wave absorber should not be less than 50 percent of the volume of the outer water-inflatable bag-like enclosure.

Baffles and tie-downs butt seamed to the upper and/or lower sheets of the outer bag-like enclosure show a high rate of failure thereby causing water leakage at these seams. The opposite would be true in the employment of such baffles and tie-downs in the inner bladder of the hydrostatic wave absorber. The inner bladder is virtually tensionless when both the inner bladder and the outer water-inflatable bag-like enclosure are water filled. Broadly considered, when properly used an equilibrium is formed between the inside and the outside of the bladder, mitigating, if not totally obviating the problem of failure due to tension on the internal wave absorber structure at the butt seams. The wave-absorbing inner bladder is essentially tensionless because there is water on both sides of the vinyl sheeting comprising the inner bladder. This advantage of the present invention is particularly important in construction of wave control mattresses where it is desirable to substantially minimize the exposed welds. In the present invention exposed welds, such as are found in the top and bottom sheets of other wave-control waterbed mattresses provided with baffles or tie-downs, are eliminated. This advantage constitutes a pioneer advance over adjustable wave-control waterbed mattresses which are often troubled with leakage failures at the welds.

Figure 10:
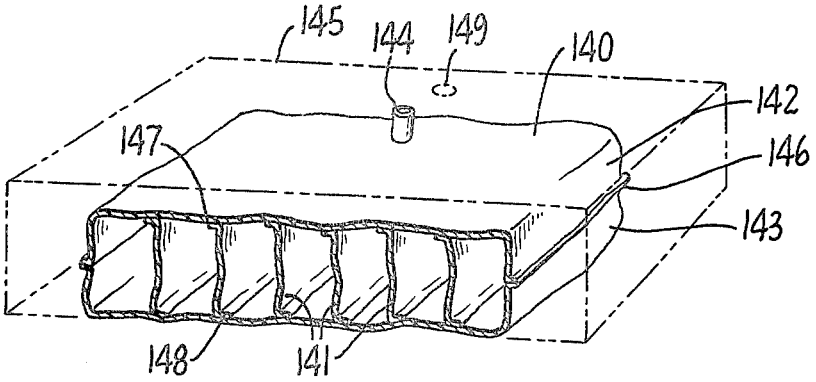
FIG. 10 is a perspective view of an improved waterbed mattress provided with an adjustable wave-absorbing water bladder which has been modified by the inclusion of baffles attached to the top and bottom of the bladder.

Referring to FIG. 10 in greater detail, there is shown a modified inner bladder 140 provided with multiple baffles 141 welded or otherwise fixedly secured to the upper sheet 142 and lower sheet 143 of the bladder. The bladder 140 is provided with a water filling means in the form of a water tube 144. The bladder is disposed within an outer bag-like enclosure 145 provided with water filling means 149. In the specific embodiment shown, the bladder is comprised of an upper sheet 142 and a lower sheet 143 welded or otherwise water sealed along the border 146. The bladder 140 is virtually tensionless when disposed within the outer water-filled bag-like enclosure 145. If the same bladder were to be used as a waterbed mattress without being disposed in this fashion within the water-filled bag-like enclosure 145, it would be prone to leakage at the butt welds 147 and 148 securing the baffles to the upper and lower surfaces. Used in the manner shown, this leakage problem is eliminated.

Figure 11:
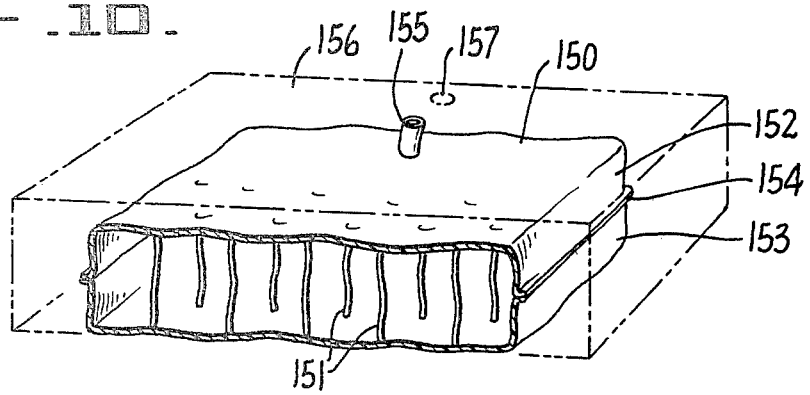
FIG. 11 is a perspective view of an improved waterbed mattress provided with an adjustable wave-absorbing water bladder which has been modified by the inclusion of ties attached to the top and bottom of the bladder.

Referring to FIG. 11 in further detail, there is shown a modified bladder 150 provided with tie-downs 151 secured to the upper sheet 152 and lower sheet 153 comprising the bladder. These sheets are welded or otherwise fixedly secured along their margins at 154 and the bladder 150 is provided with a water filling means in the form of a tube 155. Like the embodiment shown in FIG. 10, the modified bladder is disposed within an outer bag-like enclosure 156 also provided with water filling means 157.

Figure 12:
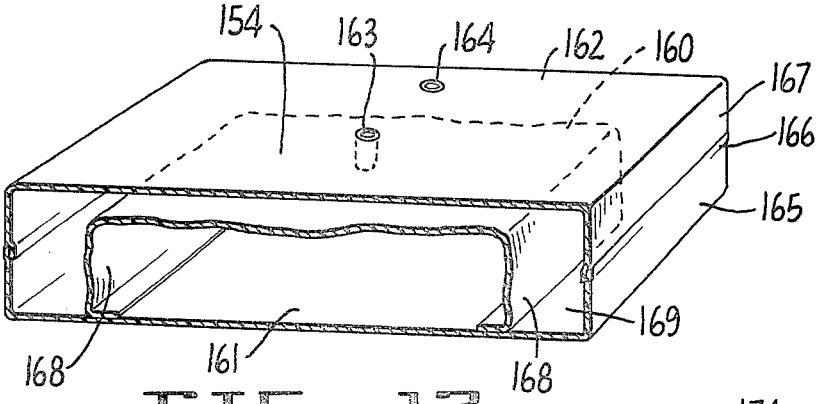
FIG. 12 is a perspective view of an improved waterbed mattress wherein the adjustable wave-absorbing water bladder and the outer waer-inflatable bag-like enclosure have a common bottom.

Referring to FIG. 12 in further detail, there is shown a bladder 160 having a common bottom 161 with the outer bag-like enclosure 142. The modified bladder 160 is provided with a water filling means in the form of a tube 163 and the outer bag-like enclosure 162 is also provided with water filling means 164. The modified bladder 160 is shown as welded to the bottom portion 169 of sheet 165. The outer bag-like enclosure 162 is comprised of sheet 165 fixedly secured or welded at 166 to sheet 167.

Referring to FIG. 12 in further detail, inner bladder 160, which has a common bottom 161 with the outer water-inflatable bag-like enclosure 162, is provided with sides 168 which are essential to the hydrostatic wave-absorbing function of the bladder. More specifically, the wave front strikes sides 168 and is blocked off by the responsive change in shape of the inner bladder 160 which substantially seals off the balance of water-inflatable bag-like enclosure 162 from wave movement. Thus, if sides 168 were secured to the sides of the outer water-inflatable bag-like enclosure 162 so that sides 168 were transformed into lateral extensions of the upper portion 154 of the bladder 160 instead of being secured to the bottom portion 169 of sheet 165 as shown there would then exist no wave-absorbing water bladder. Instead there would result a two-layered enclosure which would not provide adjustable hydrostatic wave absorption.

Figure 13:
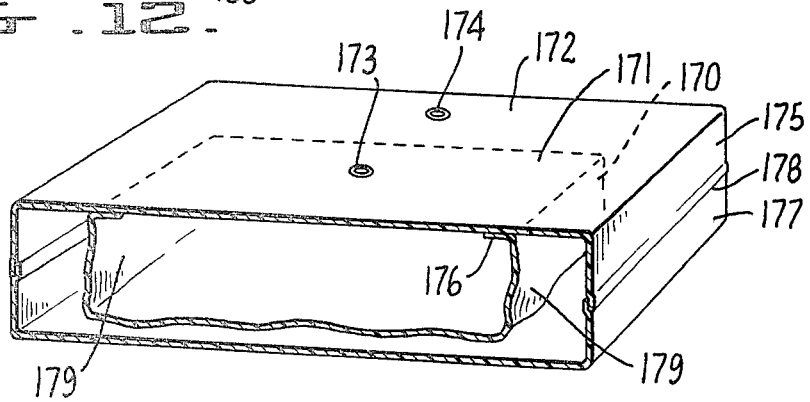
FIG. 13 is a perspective view of an improved waterbed mattress wherein the wave-absorbing water bladder and the outer water-inflatable bag-like enclosure have a common top.

Referring to FIG. 13 in greater detail, there is shown a bladder 170 having a common upper surface 171 with the upper surface of the outer bag-like enclosure 172. The bladder 170 is provided with water filling means 173 as is the outer bag-like enclosure at 174. The bladder 170 is welded to the upper sheet 175 of the outer bag-like enclosure at 176. In the specific embodiment shown, the bag-like enclosure 172 is comprised of upper sheet 175 and a lower sheet 177 welded along their margins at 178. Referring to FIG. 13 in further detail, it is essential that the inner bladder provides sides 179 to meet the undesirable wave front in the water in the outer wave-inflatable bag-like enclosure 172. Thus, as in the embodiment shown in FIG. 12, if the sides 179 were extended laterally and attached to the side portions of sheet 177 instead of being attached at 176 sides 179 would not function to provide the hydrostatic wave absorption of the present invention. Instead there would exist a two-layered configuration of water bladders which would not provide hydrostatic wave absorption without modification in accordance with the teachings of the present specification.

In accordance with the invention, as shown in FIGS. 12 and 13, the construction is devoid of two dry plastic sheets adjacent one another at the top or bottom of the bag-like structure. If desired, however, a closed water bladder, either modified or unmodified, may be fixedly secured to either the underside of the upper sheet or top side of the bottom sheet of the bag-like enclosure. As shown in FIGS. 12 and 13, the inner wave-absorbing bladder is surrounded by water when the inner bladder and the outer water-inflatable bag-like enclosure have common sides. These embodiments of the invention provide wave-absorbing function and are further advantageous in reducing the amount of plastic sheeting used in construction. They are less desirable, however, in that there is high stress caused at the points of attachment to the bag-like enclosure. In the preferred embodiments of the invention, shown in FIGS. 5 through 9, there are virtually no stress points on the inner bag in its static state.

Figure 14:
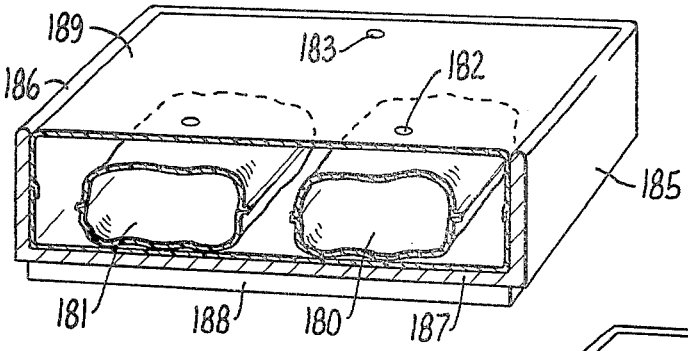
FIGS. 14 and 15 are perspective views of improved waterbed mattresses provided with hydrostatic adjustable wave-absorption wherein more than one wave-absorbing water bladder is employed.

The hydrostatic wave absorber of the present invention may be comprised of more than one wave-absorbing water bladder, either modified or unmodified, all disposed within said outer water-inflatable bag. In the FIGS. 14 through 16 inclusive, more than one such wave-absorbing water bladder is illustrated. Thus, in FIG. 14, two water bladders are shown. Each said bladder 180 and 181 is provided with a separate water tube means 182 instead of a single water tube means for both bladders. A single water tube means may be employed which is disposed to provide water for both said bladders. Alternatively, one or more integral water spouts may be employed. The bladders 180 and 181 are disposed within an outer bag-like enclosure 189 which is similarly provided with water filling means 183. The structure is housed in a rigid frame comprising side members such as 184, end members 185 and 186, a platform 187 and base 188.

Figure 15:
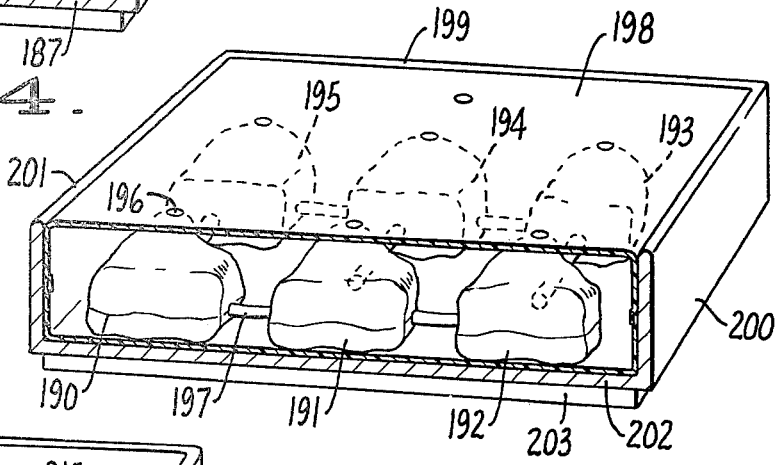

In FIG. 15, six wave-absorbing water bladders 190, 191, 192, 193, 194 and 195 constituting the hydrostatic wave absorber are shown. A separate water filling means 196 is shown for each bladder and the bladders may be connected, if desired, by water tubes 197. These multiple bladders may be individually filled through separate water filling means or alternatively one water filling means and tube connections between bladders may be employed. Employing either alternative, air escape means should be provided. The outer water-inflatable bag 198 is contained by the rigid frame comprised of side members, such as 199, end members 200 and 201, a platform 202 and base 203.

Figure 16:
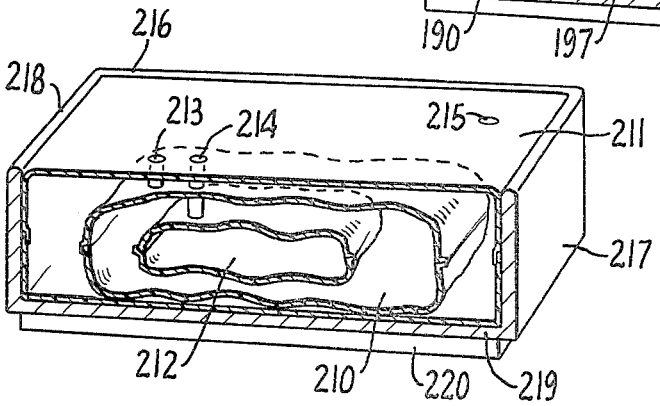
FIG. 16 is a perspective view of an improved waterbed mattress with adjustable hydrostatic wave-absorption wherein the wave-absorbing water bladder is provided with a second inner wave-absorbing water bladder.

In FIG. 16, an alternate embodiment of the invention is shown where the wave-absorbing water bladder 210 disposed within the bag-like enclosure 211 is provided with an inner water-absorbing water bladder 212. The outer water bladder 210 is provided with a water tube means 213 and the inner bladder is provided with a separate water tube means 214. The bag-like enclosure 211 is also provided with appropriate water filling means 215 and is contained within the rigid frame comprised of side members such as 216, end members 217 and 218, a platform 219 and a base 220.

Figure 17:
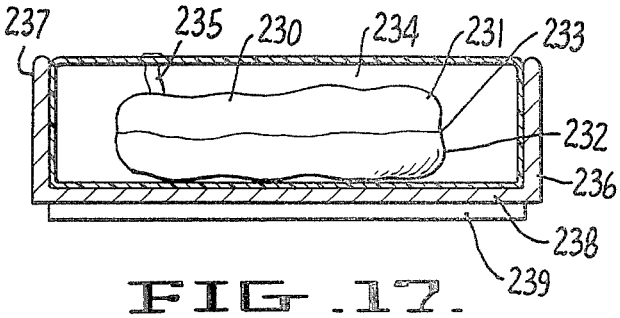
FIG. 17 is a cross-sectional view of an improved waterbed mattress showing an improved waterbed mattress with adjustable hydrostatic wave-absorber provided with the wave-absorbing water bladder having a separate water tube means for filling.
Figure 18:
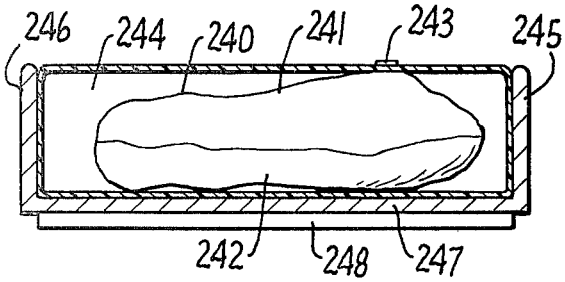
FIG. 18 is a cross-sectional view of an improved waterbed mattress with adjustable hydrostatic wave-absorption wherein the wave-absorbing water bladder is provided with an integral water spout for filling.

In FIGS. 17 and 18, alternate means of filling the wave-absorbing water bladder are shown. In FIG. 17, the bladder 230, comprised of an upper sheet 231 and lower sheet 232 secured or welded at 233, is disposed within the bag-like enclosure 234 and is provided with a water filling means in the form of water tube 235. The bag-like enclosure 234 is contained within a rigid frame comprised of end members 236 and 237, platform 238 and a base 239. In FIG. 18, an integral water filling means is depicted. More particularly, the bladder 240 comprised of an upper sheet 241 and lower sheet 242 is provided with an integral water filling means 243 which penetrates the bag-like enclosure 244. The enclosure 244 is contained within the rigid frame comprised of end members 245 and 246, a platform 247 and a base 248.

Figure 19:
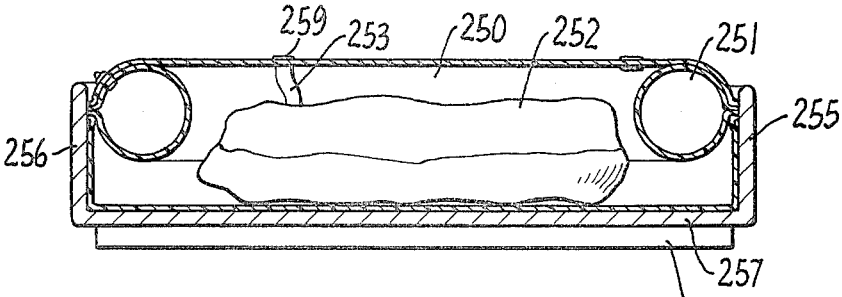
FIG. 19 is a cross-sectional view of an improved waterbed mattress with adjustable hydrostatic wave-absorption which is additionally provided with peripheral float means to provide additional edge support and wavelessness.

FIG. 19 shows another alternate embodiment of the present invention wherein the bag-like enclosure 250 is provided with flotation means 251 along its margin thereby providing edge support to a user sitting on the edge of the bed. This concept is described in detail in Applicant's U.S. Pat. No. 3,864,768. The bag-like enclosure 250 is provided with a peripheral pneumatic float tube 251 which, when air filled, provides buoyant edge support around the upper periphery of the top panel of the enclosure. The peripheral pneumatic float tube 251 is provided with an air inflation tube whereby it may be filled. In the embodiment shown, the bladder 252 is provided with a water filling means in the form of a water tube 253 which penetrates the outer bag-like enclosure at 259. The outer bag-like enclosure 250 is contained within a conventional rigid frame. In FIG. 19, the end members 255 and 256, the platform 257 and base 258 of the rigid frame are shown.

It should be understood that only float tube 251 is air filled. If a wave-absorbing inner bladder were filled with air rather than water it would not operate in the manner intended by the present invention. First, stress points would exist on the interface between the inner air-filled bladder and the outer water-filled enclosure. Moreover, the inner bladder would float up to the surface so that the bed user would be resting on an air mattress rather than a water mattress. In contradistinction thereto, the present invention provides water flotation, inhibits undesirable wave movement and is virtually tensionless. When air is used, tension without water flotation is created because of the dissimilar fluids of different specific densities also resulting in excessive seam stresses.

Figure 20:
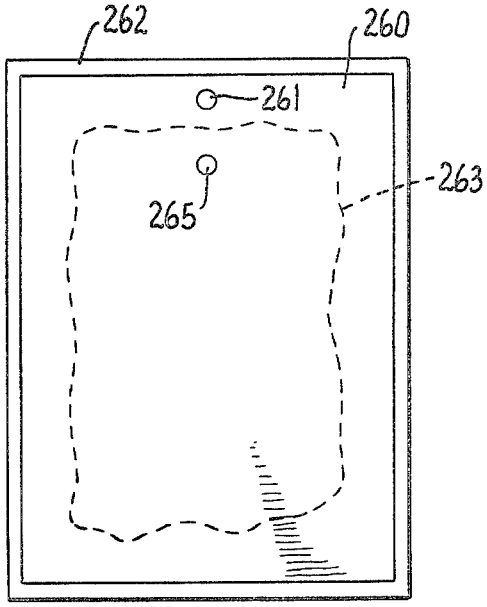
FIG. 20 is a top view of an improved waterbed mattress with adjustable hydrostatic wave-absorption wherein both the outer water-inflatable bag-like enclosure and the inner wave-absorbing water bladder are rectangular in shape and the bladder is untethered.
Figure 21:
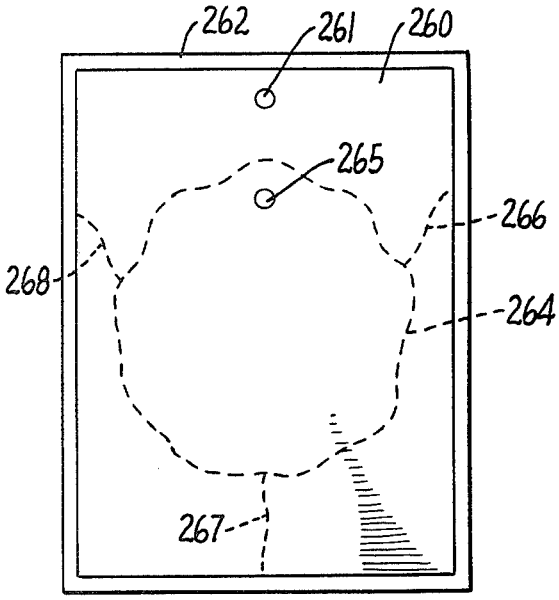
FIG. 21 is a top view of an improved waterbed mattress with adjustable hydrostatic wave-absorption showing a rectangular outer water-inflatable bag-like enclosure and a substantially circular inner wave-absorbing water bladder with multiple tethers.

The wave-absorbing water bladders of the present invention may vary considerably in shape as well as number. They may be rectangular, as shown in FIG. 20, or circular, as shown in FIG. 21. Additionally, they may be free form, multi-branched, trapezoidal, or "T"-shaped without departing from the scope of the present invention. Similarly, the bag-like enclosure may vary considerably in shape.

Figure 22:
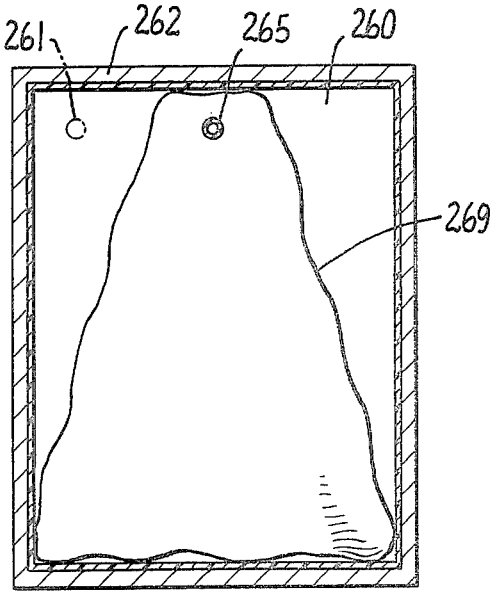
FIGS. 22 and 23 are top views of improved waterbed mattresses with adjustable hydrostatic wave-absorption wherein the inner water-absorbing water bladder is trapezoidal-shaped and T-shaped respectively.
Figure 23:
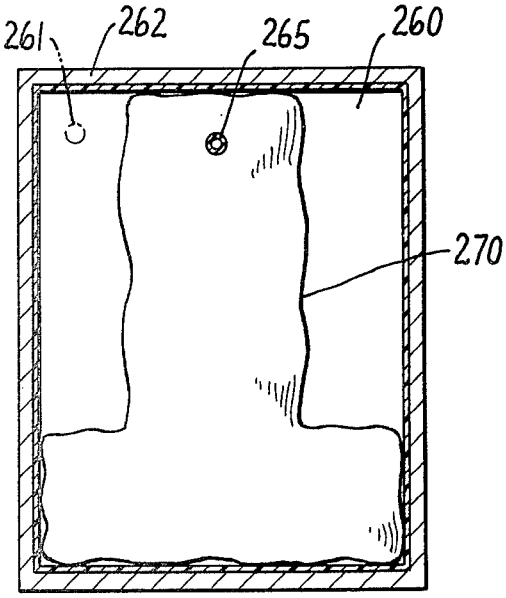

Referring more specifically to FIGS. 20 through 23, each bag-like enclosure 260 is provided with a water filling means 261 and is disposed within an outer rigid frame, such as is shown generally at 262. In FIG. 20, a substantially rectangular bladder 263 is shown without tethers. In FIG. 21, a substantially circular bladder 264 is shown provided with water filling means 265. The bladder 264 is provided with tethers 266, 267 and 268. In FIG. 22, a substantially trapezoidal-shaped bladder 269 is shown, and in FIG. 23 a "T"-shaped bladder 270 is illustrated. Both are provided with water filling means. If desired, one or more tethers, such as shown in FIG. 21, may be employed.

The advantage of the bladder with trapezoidal shape, shown in FIG. 22, is that it limits lateral movement. More particularly, the broad base of the trapezoid of the inner bladder tends to limit the twist on the valve. The disadvantage, however, is that there is a loss in efficiency in wave inhibition at the broad end of the trapezoid. The "T"-shaped bladder in FIG. 23 operates in the same manner.

Because of the unique construction of the improved waterbed mattress as heretofore described, a long tether may be used to bring about a result other than that found in existing waterbed mattresses. When the inner bladder is drained with a high volume pump prior to drainage of the outer water-inflatable bag-like enclosure, the inner bladder may collapse in accordian-like fashion. A long tether can be attached to the inner bag at a point at the end of the bladder opposite to the water filling means thereby limiting the degree of this accordian-like collapsing and preventing the inner bladder from twisting around and/or otherwise obstructing the water filling means of the inner bladder.

If the outer water-inflatable bag-like enclosure is drained prior to drainage of the inner bladder, the inner bladder will no longer float. However, if, under certain conditions, the unit is raised at the end opposite the water filling means of the inner bladder to drain the remaining water from the inner bladder, a long tether will prevent the inner bladder from wrapping and/or twisting about its water filling means. The length of the tether so employed may vary considerably. It is essential, however, that the tether is sufficiently long to permit uninhibited movement of the inner bladder in operation. In waterbeds of conventional size, a tether of approximately two to three feet is sufficient to provide uninhibited movement while preventing the inner bladder from wrapping and/or twisting around its water filling means.

Another manner of preventing the accordian-like collapsing is to provide the inner bladder or bladders with a water-insoluble fibrous material such as resin-coated fiberglass element of very low density, or similar low density material having a net-like or thread-like structural form. The term density as used herein means the density of the lofted fibrous materials based upon the weight and volume of the material in air rather than the density of the individual fibers which is much greater. Highly lofted materials having a density of about 0.5 to 0.2 pounds per cubic foot, such as "Amerkool" produced by American Air Filter, are appropriate for purposes of the present invention. When such materials occupy an appreciable portion of each inner bladder's overall volume, the inner bladder or bladders will not collapse in the undesirable accordian-like fashion along their length. Additionally, wave movement in the inner bladder or bladders in inhibited. The added material is consequently particularly valuable when used in unmodified water bladders. While the inclusion of such very low density material within the inner bladder or bladders is valuable in preventing accordian-like collapsing and in inhibiting wave action in both unmodified and modified inner bladders, it will not inhibit heat transference.

Figure 24:
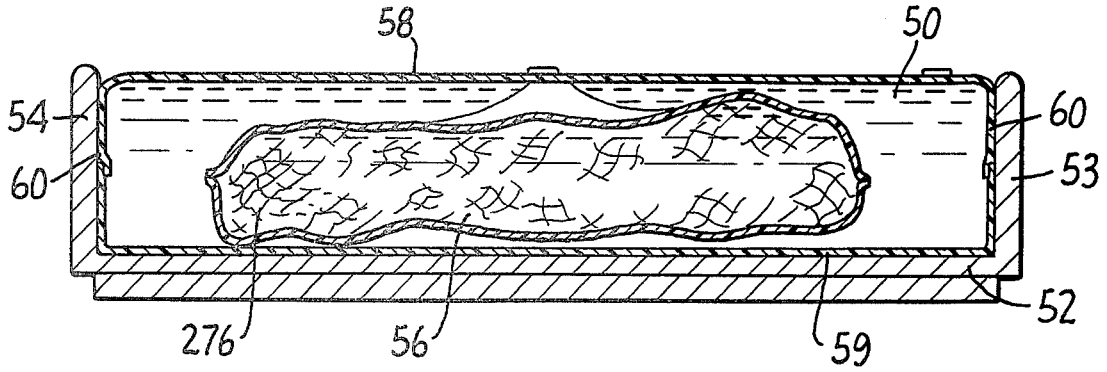
FIGS. 24 and 25 are cross-sectional views showing the inner bladder filled with a quantity of fibrous material which further inhibits wave motion.

An alternate embodiment of the subject invention utilizing fibrous material disposed within the inner bladder may be seen in FIG. 24. The mattress includes enclosure 50, top panel 58 and bottom panel 59 and edge panels 60 enclosed within the frame comprising base 52 and side members 53 and 54. Within the wave absorber a very low density, fibrous material 276 having a net-like structural form is illustrated.

Figure 25:
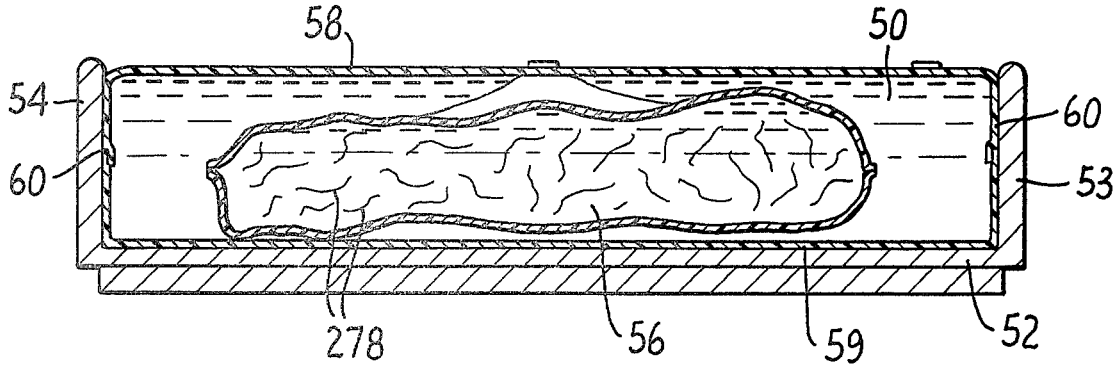

FIG. 25 shows yet another alternative embodiment of the present invention utilizing a fibrous material disposed within the wave absorber 56. The mattress includes an outer enclosure 50, top panel 58, bottom panel 59 and edge panels 60 enclosed within the frame comprising base 52 and side members 53 and 54. Within the wave absorber 56 is a very low density fibrous material 278 having a thread-like structural form. This material inhibits undesirable wave action.

I claim:

1. An improved waterbed mattress with provision for wave absorption, said mattress comprising:

an outer water-fillable bag-like enclosure having a longitudinal dimension and a lateral dimension, and having water-filling means particularly adapted for introducing water into the enclosure after manufacture of the mattress is complete;

at least one bladder disposed within said outer enclosure and filled or partially filled with liquid, and having liquid-filling means particularly adapted for use in:

filling or partially filling the bladder with liquid after manufacture of the mattress is complete, and draining liquid from the bladder when the mattress is to be moved;

said bladder being substantially smaller in longitudinal and lateral extent than the enclosure; and means for preventing collapse of the bladder and twisting of the bladder around its liquid-filling means during draining, said means comprising a quantity of fibrous material disposed within said bladder; and the mattress and the liquid-containing bladder therein are not necessarily full or partially full of liquid at the time of sale, the filling or partial filling of the mattress and bladder with liquid instead possibly occurring thereafter.

2. The waterbed mattress of claim 1 wherein said bladder is capable of lateral and vertical movement with respect to said outer enclosure.

3. The waterbed mattress of claim 2 wherein no substantial part of said bladder is directly attached to said outer enclosure.

4. An improved waterbed mattress for ordinary residential use in sleeping, and having provision for wave absorption, comprising:

an outer water-fillable bag-like enclosure having a longitudinal dimension and a lateral dimension, and having water-filling means means particularly adapted for introducing water into the enclosure after manufacture of the mattress is complete, whereby:

the enclosure can be drained and refilled, as when moving from one residence to another, and the individual comfort preferences of residential users can be implemented by adjustment of the quantity of liquid within the enclosure; and a wave-absorbing liquid-containing bladder that is:

disposed within said outer enclosure, adapted to absorb the energy of waves within the outer enclosure by means of substantial longitudinal and lateral movement of the bladder within the outer enclosure in response to such waves, said bladder being substantially smaller in longitudinal and lateral extent than the enclosure and thereby being capable of substantial lateral and longitudinal movement with respect to said outer enclosure, as well as vertical deformation, filled or partially filled with liquid, whereby the weight, inertia, and mobility of the liquid are employed in absorbing the energy of such waves, and provided with liquid-filling means particularly adapted for use by a purchaser in draining and in filling or partially filling the bladder with liquid after manufacture of the mattress is complete;

whereby the mattress with the bladder therein can be drained and refilled, as when moving from one residence to another, and whereby the individual comfort preferences of users can be implemented by adjustment of the quantity of liquid within the bladder; and the mattress and the liquid-containing bladder therein are not necessarily full or partially full of liquid at the time of sale, the filling or partial filling of the mattress and bladder with liquid instead possibly occurring thereafter.

5. The waterbed mattress of claim 4 wherein said bladder is highly deformable.

6. The waterbed mattress of claim 5 wherein no substantial part of said bladder is directly attached to said outer enclosure.

7. The waterbed mattress of claim 4, further comprising means for preventing collapse of the bladder and twisting of the bladder around its liquid-filling means during draining, said means comprising a quantity of fibrous material disposed within said bladder.

8. The waterbed mattress of claim 7 wherein no substantial part of said bladder is directly attached to said outer enclosure.

9. The waterbed mattress of claim 6 wherein said bladder is only partially filled with liquid.

10. The waterbed mattress of claim 6 wherein said bladder is highly deformable.

11. The waterbed mattress of claim 6 wherein no substantial portions of said bladder are directly connected to said outer enclosure.

12. An improved waterbed mattress with wave absorption, said mattress comprising:

an outer water-fillable bag-like enclosure provided with a water-filling means; and a wave absorber including at least one wave-absorbing water bladder partially filled with water to maintain it in a limp condition, said bladder being provided with a water-filling means and at least one tuft, each tuft having a slit to provide escape for air from one side of said bladder to the other, and said wave absorber being disposed within said outer water-fillable bag-like enclosure; and the mattress and the liquid-containing bladder therein are not necessarily full or partially full of liquid at the time of sale, the filling or partial filling of the mattress and bladder with liquid instead possibly occurring thereafter.

13. The waterbed mattress of claim 12 further comprising a fibrous material disposed within said water bladder.

14. An improved waterbed mattress with provision for wave absorption, said mattress comprising:

an outer water-fillable bag-like enclosure having a longitudinal dimension and a lateral dimension;

at least one liquid-filled or partially liquid-filled bladder disposed within said outer enclosure, and having liquid-flow means particularly adapted for use in draining liquid from the bladder when the mattress is to be moved; said bladder being substantially smaller in longitudinal and lateral extent than the enclosure; and a quantity of fibrous material disposed within said bladder;

whereby collapse of the bladder during draining is prevented; and the mattress and the liquid-containing bladder therein are not necessarily full or partially full of liquid at the time of sale, the filling or partial filling of the mattress and bladder with liquid instead possibly occurring thereafter.

15. An improved waterbed mattress for ordinary residential use in sleeping, and having provision for wave absorption, said mattress comprising:

an outer water-fillable bag-like enclosure; and a wave-absorbing liquid-containing inner bladder that is:

disposed within said outer enclosure, a unitary chamber having no internal walls or partial internal walls, adapted to absorb the energy of waves within the outer enclosure, functionally nonredundant in regard to such wave-energy absorption, relative to the outer enclosure, filled or partially filled with liquid, whereby the weight, inertia, and mobility of the liquid are employed in absorbing the energy of such waves, and provided with liquid-filling means particularly adapted for use in draining and filling or partially filling the bladder with liquid after manufacture of the mattress is complete;

whereby the mattress with the bladder therein can be drained and refilled, as when moving from one residence to another, and whereby the individual comfort preferences of residential users can be implemented by adjustment of the quantity of liquid within the bladder; and the mattress and the liquid-containing bladder therein are not necessarily full or partially full of liquid at the time of sale, the filling or partial filling of the mattress and bladder with liquid instead possibly occurring thereafter.

16. An improved waterbed mattress for ordinary residential use in sleeping; said mattress providing wave inhibition, and comprising:

an outer water-fillable bag-like enclosure suitable for installation in a conventional waterbed frame, and sized appropriately for supporting the entire body of at least one adult in a sleeping position; and wave-absorbing inner bladder means, disposed within said outer enclosure, that are:

adapted to absorb the energy of waves within the outer enclosure, filled or partially filled with liquid, whereby the weight, inertia, and mobility of the liquid are employed in absorbing the energy of such waves, provided with liquid-filling means particularly adapted for use in draining and filling or partially filling the bladder means with liquid after manufacture of the mattress is complete, and functionally nonredundant in regard to such wave-energy absorption, relative to the outer enclosure;

whereby the mattress and the bladder means therein can be filled, as in initial installation of the mattress, and can be drained and refilled, as in moving from one residence to another; and whereby the individual comfort preferences of residential users can be implemented by adjustment of the quantity of liquid within the bladder means; and the mattress and the liquid-containing bladder therein are not necessarily full or partially full of liquid at the time of sale, the filling or partial filling of the mattress and bladder with liquid instead possibly occurring thereafter.

17. An improved waterbed mattress comprising:

an outer water-fillable bag-like enclosure;

liquid-filled or partially-filled inner bladder means, disposed within and significantly movable both longitudinally and laterally with respect to said outer enclosure, for retarding wave motion in the outer enclosure; and liquid-flow means particularly adapted for adjusting the relationship of liquid volume between the outer enclosure and the inner wave-retarding bladder means;

whereby the wave-retarding effect of the inner bladder means may be adjusted independently of the total water volume; and the mattress and the liquid-containing bladder therein are not necessarily full or partially full of liquid at the time of sale, the filling or partial filling of the mattress and bladder with liquid instead possibly occurring thereafter.

18. The mattress of claim 17, further comprising:

a quantity of fibrous material disposed within said inner wave-retarding bladder means.

19. An improved waterbed mattress comprising:

an outer water-fillable bag-like enclosure;

liquid-filled or partially-filled inner bladder means, disposed within and functionally nonredundant with respect to said outer enclosure, for retarding wave motion in the outer enclosure; and at least one tether interconnecting the inner bladder means with the inside of the outer enclosure;

the length of the tether being sufficient to permit substantially uninhibited movement of the inner bladder in operation; and the mattress and the liquid-containing bladder therein are not necessarily full or partially full of liquid at the time of sale, the filling or partial filling of the mattress and bladder with liquid instead possibly occurring thereafter.

* * * * *